US006292105B1

(12) United States Patent
Land, III et al.

(10) Patent No.: US 6,292,105 B1
(45) Date of Patent: Sep. 18, 2001

(54) THERMAL IONIZATION DETECTOR

(75) Inventors: Bruce A. Land, III, Laurel; John M. Klimek, Catonsville; Leo R. Gauthier, Jr., Timonium; Christopher L. Eddins, Jessup, all of MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/469,492

(22) Filed: Dec. 22, 1999

Related U.S. Application Data

(60) Provisional application No. 60/113,366, filed on Dec. 23, 1998.

(51) Int. Cl.[7] ..... G08B 17/10

(52) U.S. Cl. ..... 340/629; 340/628; 250/381

(58) Field of Search ..... 340/628, 629, 340/632; 250/374, 381, 382, 384, 385.1

(56) References Cited

U.S. PATENT DOCUMENTS

| | | | | |
|---|---|---|---|---|
| 3,427,880 | | 2/1969 | Grobel et al. | 73/339 |
| 3,767,917 | * | 10/1973 | Lampart et al. | 250/381 |
| 3,807,218 | | 4/1974 | Carson et al. | 73/28 |
| 3,866,195 | | 2/1975 | Ried, Jr. | 340/237 S |
| 3,916,671 | | 11/1975 | Carson et al. | 73/23.1 |
| 4,037,106 | * | 7/1977 | Scheidweiler et al. | 250/381 |
| 4,096,473 | * | 6/1978 | Sweany et al. | 340/629 |
| 4,101,277 | | 7/1978 | Hickam | 23/232 R |
| 4,117,713 | | 10/1978 | Phillips et al. | 73/17 R |
| 4,121,458 | | 10/1978 | Fort | 73/339 |
| 4,208,655 | | 6/1980 | Phillips | 340/627 |
| 4,270,123 | | 5/1981 | Collard | 340/629 |
| 4,364,032 | | 12/1982 | Narato et al. | 340/679 |
| 4,379,290 | * | 4/1983 | Muggli et al. | 340/629 |
| 4,401,978 | | 8/1983 | Solomon | 340/628 |
| 4,868,546 | | 9/1989 | Dumbeck | 340/632 |
| 5,157,380 | | 10/1992 | Braun et al. | 340/647 |
| 5,362,568 | | 11/1994 | Dietz et al. | 428/421 |
| 5,563,578 | | 10/1996 | Isenstein | 340/521 |

* cited by examiner

*Primary Examiner*—Edward Lefkowitz
(74) *Attorney, Agent, or Firm*—Francis A. Cooch

(57) ABSTRACT

An ionization chamber that detects changes in temperature of electrical insulation with a corresponding change in voltage. This voltage change can be relayed through an operational amplifier and a comparator to a device receiving the signal, thus triggering the necessary alarm and preventing fires caused by electrical arcing.

13 Claims, 1 Drawing Sheet

THERMAL IONIZATION DETECTOR

CROSS-REFERENCE TO RELATED APPLICATION

This application claims the benefit of prior filed co-pending U.S. Provisional Application Ser. No. 60/113,366, filed on Dec. 23, 1998.

STATEMENT OF GOVERNMENTAL INTEREST

This invention was made with Government support under Contract No. N00039-95-C-0002 awarded by the Department of the Navy. The Government has certain rights in the invention.

BACKGROUND OF THE INVENTION

1. Field of the Invention

The invention relates generally to arc fault detectors and, more particularly, is a device for sensing the temperature of insulation to detect when it is about to fail, and, therefore, for predicting and preventing a fire based on the resultant electrical arcing.

2. Description of the Related Art

U.S. Pat. No. 5,157,380 to Braun et al. discloses the use of a metal oxide semiconductor (MOS) detector to analyze the exhaust of a turbo generator for overheated insulation. This device detects carbon monoxide and methane breakdown products for the insulation and requires on-line reference gas, automatic valves, pumps and associated control electronics. Stability of the technique is a problem which is why on-line calibration is necessary. MOS detectors sense many other gases in addition to overheated insulation products. In short, they are not very specific when they are exposed to the random contamination experienced on a ship. They will alarm for jet engine exhaust, diesel exhaust, paint fumes, freon, and many other gases. This makes them most suitable in locations where the atmosphere is clean and closely controlled. On board a ship they give too many false alarms to be useful. The complexity and cost of Braun et al.'s technique make it suitable only to protect centralized high dollar value items such as very large motors and generators.

U.S. Pat. No. 5,362,568 to Dietz et al. requires treating all surfaces to be protected with tagged compounds. If different materials in the turbo generator are treated with different tracers one can determine which material is overheating before you open the generator for repair. This is an advantage over the bulk detection method by Braun et al. Dietz et al. then perform standard analysis using a standard gas chromatograph. This requires the used of two bottles of high pressure gas, one to calibrate (called "reference gas") and the second to operate the analyzer. Additional pumps, valves, and control electronics are also required. This is a typical batch analysis and is not continuous. Because of the high complexity and cost of this system it is warranted only when protecting centralized high dollar value items such as the large motors and generators. This method will not work with existing equipment since the original insulation would not contain the needed tracers.

U.S. Pat. Nos. 3,916,671 and 3,807,218, to Carson et al. are for a gas sampling method and gas chromatograph analysis of the cooling gas from the generator to identify pyrolysis products which would identify the overheated component without disassembly of the machine. All of the comments above made about the patent to Dietz et al. apply. This is a large expensive off-line analyzer suitable to expensive generators.

U.S. Pat. No. 4,117,713 to Phillips et al. refers to a particulograph. The drawings attached show the need for several valves, a detector of some sort and an analyzer gas supply. The discussion on size, complexity, and cost for the gas chromatographic methods applies here.

U.S. Pat. No. 4,101,277 to Hickam analyzes the ratio of oxygen to nitrogen rather than the direct overheating gaseous products. Hickam states that even in the hydrogen cooled generators there are traces of air. Since the ratio of oxygen to nitrogen in air is stable and known it should be the same ratio in the generator. If the ratio changes then oxygen must have been consumed in the pyrolysis of insulation which was overheated. Technically this does not identify overheated components, it determines if the bulk heating exceeded the oxidation temperature of the materials. It is probably less expensive than the gas chromatograph methods, but will not furnish any information about which material is overheating.

U.S. Pat. No. 3,427,880 to Grobel et al. discusses the use of ionization chambers to detect the pyrolysis products of overheated insulation. The ionization chamber is of a different type than the one Applicants use. Grobel et al. uses Thorium 232 and coats the surfaces to be monitored.

U.S. Pat. No. 4,121,458 to Fort points out that the invention of the '880 patent to Grobel et al. has problems due to changes in gas pressure, gas purity, gas flow rate, and contamination of the radioactive source. Fort then describes the use of dual ionization chamber which addresses some of the problems.

U.S. Pat. No. 4,364,032 to Narato claims that increased sensitivity can be had by integrating the rate of pyrolysis product generated over time. This works only on sealed systems and only if the mass of protected insulation is known and accounted for in the calibration curve. If one knows that the box to be protected contains 5 lb. of insulation then one can analyze the total amount of insulation lost per time. If one presumes that the insulation loss is evenly distributed over the total amount of insulation present then a threshold can be set, say 1.0%, at which an alarm will be set. In machinery with forced cooling one can presume that the heat is evenly distributed by the cooling medium over the entire machine. In this manner one can justify alarming upon the total amount of insulation lost.

The method of Narato will not detect gross overheating of a single small spot. For instance, one can set the alarm at an effective total temperature of 5 watts per square foot times 10 feet or 50 watts total heat. A hot spot of 100 watts over a surface of 0.1 square foot would look like 10 watts total heat and not alarm. However 100 watts is considerably over the 50 watts selected for the alarm. Therefore in many cases the integration method creates problems during actual application. The integration method means that there are an infinite number of surface area times heat times time which will produce the same integral value. This means small very hot spots can be missed.

All of the above patents generally relate to detection of overheated insulation in large expensive generators. These units can cost several million dollars and frequently are larger than the typical office. Repairs are expensive and down time is lost revenue. If one can detect an imminent failure, one can perform repairs before the damage and cost are catastrophic. If one can identify which part is failing before opening the machine, one can have the parts on hand before bringing the machine off line. This reduces lost revenue due to down time. Hence the interest in coating parts with tracers or identifying the composition of the failing part from its off-gassing. If the possible lost revenue is thousands of dollars per hour, the size and cost of the analyzer to reduce down time is not of major importance.

The methods in the above patents are generally applicable to gas cooled equipment. The circulation of the above cooling gas is used to transport the pyrolysis byproducts to a point where they can be sampled. The detectors are not suitable for actual insertion into the equipment being monitored.

In summary, the above systems all have many similar disadvantages:

- The items are not suitable for use outside a closed environment. They are not specific when they are exposed to random fluctuations, such as jet engine exhaust, diesel exhaust, paint fumes, freon, and many other gases.
- The systems depend on the background gases being known and constant to prevent false alarms.
- They cannot be installed into the equipment actually being monitored. They require circulation of cooling gas to transport the pyrolysis by-products to a point where they can be sampled.
- The units are only cost-efficient when protecting high value items. None of the items have a low cost per item protected.
- The items require modifications to the existing insulation being detected; the material must be inundated with tracers or the use of specific coatings.
- Most of the units involve consumables, such as the calibration gases. These gases must be replenished in order for the system to work properly.

SUMMARY OF THE INVENTION

The invention comprises a conventional smoke detector's radioactive ionization chamber and added custom electronics to allow the detection of the early outgassing of overheated electrical insulation before it breaks into an electrical fire. Failing insulation can be detected at 200 to 300° C. which is well below the 1083° C. necessary to melt copper conductors. By correlating the output signal to the temperature of the insulation, the invention turns the smoke detector into a temperature sensor allowing detection of failing insulation and, thus, the prediction of arcing failure in electrical systems and the output of a signal directing that preventative maintenance to be performed. The signals can be networked to allow protection of many enclosures.

Several objects and advantages of the present invention are:

- detection of the temperature of the insulation with a device which is small and can be installed inside existing enclosures that contain wires.
- detection of the temperature of the insulation in open enclosures without the use of forced circulation of cooling gas.
- detection of the temperature of insulation without modification of the existing insulation to be protected.
- detection of the temperature of the insulation in systems by one system that can be used in different environments; the device can be used in ships and aircraft, as well as on land-based systems.
- detection of the temperature without the use of consumables such as tracer gases in order to detect the state of the insulation.
- protection for items which do not have high specific costs associated with them due to the inexpensive nature of the invention.
- networking of the signals for multiple detectors to allow protection of many electrical enclosures.
- detection of particles in the invention's ionization chamber provides a much higher level of immunity to false signals than does the sensing of gases as is done in the prior art.

DETAILED DESCRIPTION OF THE INVENTION

Figure 1:
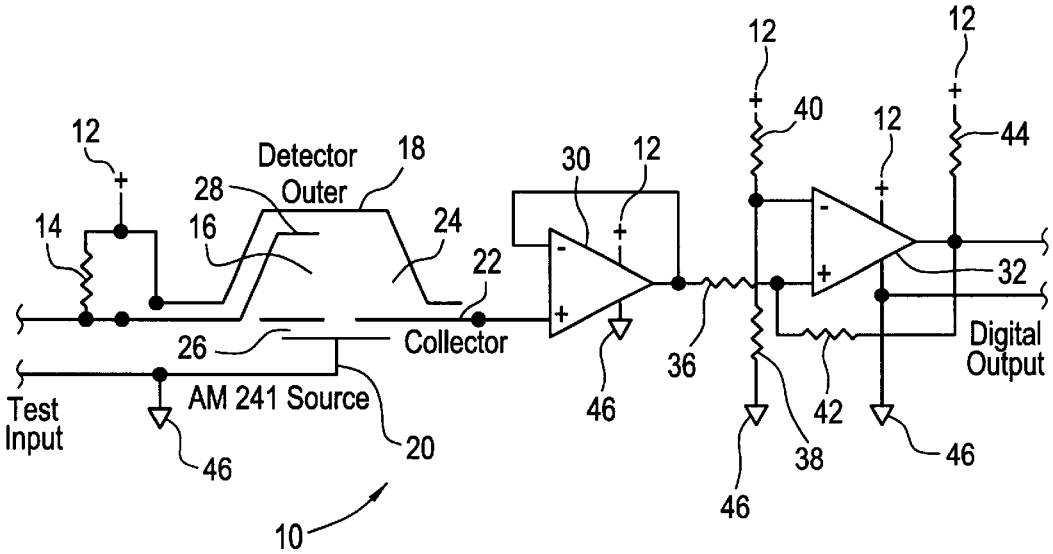
FIG. 1 shows an embodiment of the invention with a digital output when the alarm level is reached.

A digital embodiment of the invention is illustrated in FIG. 1. The detector of the invention 10 operates from a DC power supply 12 located in the control unit. A resistor 14 sets the test input electrode 28 in the nontest mode.

The invention makes use of an ionization chamber 16, for example, chambers manufactured by AEA Technology, QSA Incorporated. The chamber 16 contains a single radioisotope 20, Americium 241, providing ionization inside the chamber. A DC voltage potential applied across the chamber 16 induces the ions to flow within the chamber 16. The outer cap electrode 18 is tied to the plus voltage while the source electrode 20 is tied to the ground 46.

A collector electrode 22 divides the chamber 16 into two sections. The upper section 24 is the area between the collector electrode 22 and the outer cap electrode 18. The lower section 26 is the area between the collector electrode 22 and the source electrode 20. The collector electrode 22 is charged to a potential by the ionization currents flowing within the chamber 16 which eventually comes into balance between the two sections.

The balance potential in clean air is typically ⅔ of the supply voltage. When particles enter the chamber via diffusion through holes in the outer cap electrode 18, they disturb the current flow in the upper section of the chamber 24 more so than in the lower section 26. When this occurs the potential at the collector electrode 22 falls due to the imbalance of ionization currents. Connection of the test input electrode 28 to the ground 46 causes a similar unbalance and allows automatic testing of the unit's functionality.

The change in collector potential triggers the alarm circuit. This potential is buffered by a high input impedance operational amplifier 30. The output of the buffer is tied to a comparator, in this case to a non-inverting comparator 32. (The discussion that follows references, and the figures show, a non-inverting comparator; however, inverting comparators will also work. Which one is used depends upon whether one desires a plus or a negative output to be compatable with the follow-on circuit.) A reference voltage for the comparator 32 is supplied by a voltage divider, made up of resistors 38 and 40. The reference voltage sets the threshold level at which the comparator 32 output changes state. A value of 50% of the supply voltage gives a threshold corresponding to an abnormally high cable insulation temperature of 220 to 270 degrees Celsius.

The trip point is easily varied by selecting different values for resistors 38 and 40. The combination of resistors 36 and 42 adds 300 mV of hysterisis to the comparator 32. The open collector output of the comparator 32 is pulled up to the plus voltage by a resistor 44 when the potential at the collector electrode 22 is above the reference voltage. When the potential at the electrode falls below the reference voltage, the output of the comparator 32 pulls the signal TID_ALARM low. This signal can be tied to the input of another device, such as an opto-coupler in the control unit. The TID_HI signal can then sink a current to the input LED of the opto-coupler when TID_ALARM goes low.

Figure 2:
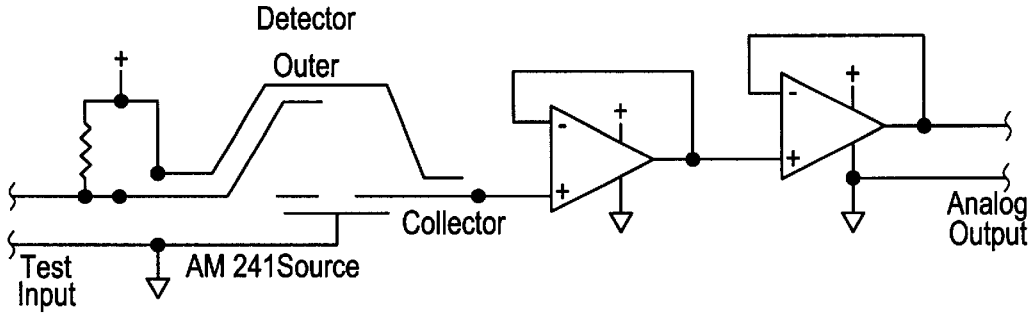
FIG. 2 is a circuit diagram of an analog embodiment of the invention which has an analog output that is a function of the temperature and an alarm threshold that can be set by the instrumentation receiving the signal.

FIG. 2 shows the analog embodiment of the thermal ionization detector. The analog output of this embodiment is a function of the temperature. The alarm threshold is then set by a device receiving this signal.

The detector of the invention is small and capable of being installed inside of existing enclosures which contain wires. The enclosures for the invention do not have to be sealed and do not require forced circulation of cooling gas to bring the pyrolysis products to the detector. The invention is inexpensive and capable of being chained together to cover many different locations. The invention requires no modifications to the existing insulation to be protected, no materials containing tracers or specific coatings, and no modification to the enclosure. If it is desired to protect non-insulated connections then they must first be coated with standard insulating paint (no tracers). The invention requires no consumables such an analyzer gases. It will detect a single overheated connection in an enclosure containing hundreds of connections and will work with relatively high ambient operating temperatures, 50° C.

At present, the invention will be used in main shipboard electrical distribution systems (also called switchboards or load centers), but it could be used in aircraft and land based systems as well. Land base uses would include main AC power distribution panels, electrical substation panels, and power distribution systems in large plants or in power generation facilities. The device could be embedded in any critical electrical enclosure such as a mainframe computer. It could also be used to assist in protecting transformers and generators from failure.

We claim:

1. A temperature sensor for detecting the early outgassing of overheated electrical installation comprising:

an ionization chamber containing a radioisotope for providing ionization inside the chamber;

a direct current (DC) power supply for appying a voltage potential across the ionization chamber thereby inducing ions to flow within the ionization chamber;

the ionization chamber further comprising:

an outer cap electrode connected to the plus voltage of the DC power supply;

a source electrode connected to ground;

a collector electrode for dividing the ionization chamber into two sections, an upper section between the collector electrode and the outer cap electrode and a lower section between the collector electrode and the source electrode whereby the collector electrode is charged to a potential by the ionization currents flowing within the ionization chamber, the ionization currents coming into balance between the two sections;

a high input impedance operational amplifier for buffering the potential at the collector electrode;

a comparator, the output of the comparator changing state based on a reference voltage;

a voltage divider for supplying the reference voltage to the comparator;

wherein particles from the early outgassing of overheated electrical insulation enter the ionization chamber causing an imbalance in the ionization current flow in the upper and lower sections of the ionization chamber thereby causing the potential at the collector electrode to fall below the reference voltage for the comparator and triggering an alarm.

2. The temperature sensor as recited in claim 1, the voltage divider comprising a first resistor and a second resistor.

3. The temperature sensor as recited in claim 2, wherein the threshold level at which the comparator output changes state can be varied by changing the reference voltage supplied by the voltage divider by selecting different values for the first and second resistors.

4. The temperature sensor as recited in claim 3, further comprising a means for indicating an alarm.

5. The temperature sensor as recited in claim 4, the alarm means comprising an opto-coupler, the opto-coupler containing an LED for responding when the potential at the collector electrode falls below the reference voltage for the comparator.

6. The temperature sensor as recited in claim 5, the ionization chamber further comprising a test input electrode for causing an imbalance of ionization currents in the ionization chamber, thereby permitting the automatic testing of the ionization chamber.

7. The temperature sensor as recited in claim 1, wherein the sensor provides an analog output, the analog output being a function of the temperature.

8. The temperature sensor as recited in claim 7, wherein the alarm threshold is set by a device receiving the analog output signal.

9. A method for sensing the temperature of early outgassing of overheated electrical insulation, the method comprising the steps of:

placing an ionization chamber containing a radio isotope in an enclosure containing the electrical insulation;

sensing particles from the outgassing of overheated electrical insulation that diffuse into the ionization chamber, the particles creating an imbalance of ionization currents in the ionization chamber thereby causing the potential at a collector electrode in the ionization chamber to fall; buffering the potential at the collector electrode using a high input impedance operational amplifier;

providing a reference voltage to a comparator for setting a threshold level at which the comparator output changes state;

signaling an alarm when the potential at the collector electrode falls below the reference voltage causing the comparator output to change state.

10. The method as recited in claim 9, further comprising the step of varying the threshold level at which the comparator output changes state by changing the values for resistors comprising a voltage divider supplying the reference voltage to the comparator.

11. The method as recited in claim 10, further comprising testing the sensor by activating a test input electrode to cause an imbalance in the ionization currents in the ionization chamber.

12. The method as recited in claim 9, wherein the sensor provides an analog output as a function of the sensed temperature.

13. The method as recited in claim 12, wherein the alarm threshold is set by a device receiving the analog output.

* * * * *

UNITED STATES PATENT AND TRADEMARK OFFICE

CERTIFICATE OF CORRECTION

PATENT NO. : 6,292,105 B1
DATED : September 18, 2001
INVENTOR(S) : Land, III et al.

It is certified that error appears in the above-identified patent and that said Letters Patent is hereby corrected as shown below:

Title page,
Inventors, delete "Bruce A. Land, III" and substitute therefor -- H. Bruce Land, III --.

Signed and Sealed this

Fourteenth Day of May, 2002

*Attest:*

JAMES E. ROGAN
*Director of the United States Patent and Trademark Office*

*Attesting Officer*